US005277032A

United States Patent [19]

See et al.

[11] Patent Number: 5,277,032

[45] Date of Patent: Jan. 11, 1994

[54] APPARATUS FOR RECOVERING AND RECYCLING REFRIGERANTS

[75] Inventors: Harold J. See; Kenneth D. Turner, both of Abilene, Tex.

[73] Assignee: CFC Reclamation and Recycling Service, Inc., Abilene, Tex.

[21] Appl. No.: 915,924

[22] Filed: Jul. 17, 1992

[51] Int. Cl.[5] ..... F25B 49/00

[52] U.S. Cl. ..... 62/125; 62/77; 62/292; 62/475

[58] Field of Search ..... 62/77, 85, 195, 149, 62/292, 475, 125

[56] References Cited

U.S. PATENT DOCUMENTS

| | | | |
|---|---|---|---|
| 4,646,527 | 3/1987 | Taylor | 62/85 |
| 4,856,289 | 8/1989 | Lofland | 62/292 |
| 4,939,903 | 7/1990 | Goddard | 62/77 |
| 5,094,087 | 3/1992 | Gramkow | 62/292 |

*Primary Examiner*—John Sollecito
*Attorney, Agent, or Firm*—Daniel V. Thompson

[57] ABSTRACT

Apparatus for recovering and recycling refrigerant fluid includes an external or open drive compressor having a suction side and a discharge side, an inlet port for receiving refrigerant fluid from a refrigeration unit, a suction conduit communicating between the inlet port and the suction side of the compressor, an outlet port for expelling refrigerant fluid from the apparatus and a discharge conduit communicating between the discharge side of the compressor and the outlet port. The apparatus further includes a filter for filtering moisture and other contaminants from the incoming refrigerant and an evaporator for substantially completely vaporizing the incoming refrigerant before it reaches the suction side of the compressor. The apparatus does not include a dedicated condenser, but rather the refrigerant discharged by the compressor is condensed in a series of heat exchange processes, whereby the warmer refrigerant discharged from the compressor gives up heat to the cooler incoming refrigerant. The high temperature, high pressure vapor discharged by the compressor is used to help vaporize the incoming refrigerant. A combination accumulator/heat exchanger is provided for accumulating unvaporized refrigerant before the refrigerant enters the compressor and for condensing the refrigerant discharged by the compressor. A feedback line is provided for providing a flow of refrigerant from the discharged conduit to the suction conduit when the apparatus is operated in a "pump down" mode.

17 Claims, 3 Drawing Sheets

APPARATUS FOR RECOVERING AND RECYCLING REFRIGERANTS

FIELD OF INVENTION

This invention relates generally to apparatus for recovering refrigerants and in particular to an improved apparatus for recovering and recycling refrigerants.

BACKGROUND OF THE INVENTION

Materials used as refrigerants are typically chlorinated fluorocarbons, which are used because of their relative stability and non-flammability and because such materials boil and condense in a useful temperature and pressure range. An example of a chlorinated fluorocarbon refrigerant is the refrigerant sold under the trademark FREON by duPont de Nemours.

Until recently, such refrigerants were believed to be relatively inert and free of harmful side effects. Recently, however, it has been discovered that such refrigerants have a detrimental effect on the ozone layer above the earth when released into the atmosphere, such that it is now necessary to avoid open air release of refrigerants from equipment, such as refrigerators, air conditioning units, heat pumps and the like.

In normal use, refrigerants are constantly recycled within refrigeration equipment and are not released to the atmosphere. However, over time, refrigerants gradually become contaminated by water, air, compressor oil, hydrochloric acid, waxes, varnishes and the like, and lose their effectiveness. Such contaminants accelerate the rate of breakdown of the refrigerants and increase the operating temperatures of the compressors used in the refrigeration equipment. Prolonged operation of a refrigeration compressor at higher temperatures often causes compressor or compressor drive failure.

For many years, it was common practice in the industry simply to release the contaminated refrigerant to the atmosphere. Now, however, because of more stringent environmental regulations, such practice is no longer tolerated. It is therefore desirable in servicing refrigeration units to be able to recover the refrigerants in them and replace the refrigerants after servicing has been completed in a manner which substantially prevents any loss of either contaminated or pure refrigerants to the atmosphere.

DESCRIPTION OF THE PRIOR ART

Although different types of apparatus have been used and proposed for use in removing refrigerant from refrigeration equipment, recycling the refrigerant and replacing it for reuse, such apparatus has heretofore been limited in application, inefficient in use and not sufficiently effective to prevent loss of refrigerant to the atmosphere. At least one type of prior art apparatus is adapted to receive refrigerant only in a vapor phase, while another type of apparatus is adapted to receive refrigerant only in a liquid phase. In other types of prior art apparatus, the refrigerant is not fully recovered from the refrigeration unit, with the result that some of the refrigerant is lost to the atmosphere. Moreover, the processes of recovering and recycling the refrigerant can also impart impurities thereto, such as, for example, oil from the compressor used in the recovery equipment. Even an impurity level of as little as one percent can significantly impair the heat exchange capabilities of the refrigerant and shorten its life span.

In U.S. Pat. No. 4,856,289, apparatus for reclaiming and purifying chlorinated fluorocarbons is disclosed. The apparatus is adapted to receive refrigerant in either a vapor or a liquid state. The refrigerant is distilled and purified in a vapor state. The vapor is then superheated, compressed and condensed to a liquid state and is further purified in the liquid state. Heat from the condensed liquid is used to help vaporize incoming liquid refrigerant and to superheat the vapor prior to compression. This type of apparatus is typically used for refrigerant reclamation and requires relatively expensive distillation and condensing components.

There is therefore a need for an effective and economical apparatus for recovering and recycling refrigerants. There is also a need for an apparatus for recovering and recycling refrigerants, whereby the recovered refrigerant is purified to some extent, but not to the extent required for reclamation.

DISCLOSURE OF THE INVENTION

In accordance with the present invention, apparatus is provided for recovering and recycling refrigerant fluid. The apparatus includes inlet means positionable in fluid communication with a refrigeration unit for receiving refrigerant fluid therefrom, outlet means for expelling refrigerant fluid from the apparatus, vaporizing means for converting incoming refrigerant fluid to a vapor state, compressor means for compressing the vaporized refrigerant fluid to increase the temperature and pressure thereof, and condensing means for condensing the refrigerant fluid discharged from the compressor means so that the refrigerant fluid is discharged from the apparatus in a liquid state.

In accordance with a unique feature of the invention, feedback means is provided for providing a flow of refrigerant fluid back to the inlet means under certain conditions. The feedback means is used when the apparatus is in a "pump down" mode, whereby refrigerant fluid is evacuated from the apparatus after the refrigerant fluid has been substantially completely recovered from the refrigeration unit. Providing a feedback flow of refrigerant fluid to the inlet means allows the compressor means to continue to operate to evacuate substantially all of the refrigerant fluid remaining in the apparatus.

In one embodiment, the feedback means includes a solenoid-operated valve, which is normally in a closed position for inhibiting the flow of refrigerant fluid through a feedback conduit. When the solenoid-operated valve is moved to an open position, refrigerant fluid is allowed to flow through the feedback conduit to provide a flow of refrigerant fluid on the suction side of the compressor means until refrigerant fluid has been substantially completely evacuated from the apparatus.

In accordance with another unique feature of the invention, a "quick liquid recovery" means is provided. A "quick liquid recovery" port is in fluid communication with the outlet means. When the "quick liquid recovery" port is positioned in fluid communication with the refrigeration unit from which refrigerant fluid is to be recovered, the residual pressure in the refrigeration unit forces refrigerant fluid through the "quick liquid recovery" port into the outlet means, thereby bypassing the vaporizing means, compressor means and condensing means of the apparatus. The "quick liquid recovery" mode is particularly well-suited for use when the refrigerant fluid to be recovered is substantially in a liquid state and is sufficiently pure so as not to require filtration or oil separation. To this end, visual inspection means (e.g., a sight glass) is positioned adjacent the outlet means to allow visual inspection of the refrigerant fluid being discharged through the outlet means.

In accordance with yet another unique feature of the invention, the apparatus includes a combination accumulator/heat exchanger. The accumulator portion is used to collect refrigerant fluid which has not been vaporized before the refrigerant fluid enters the compressor means. The heat exchanger portion is adapted to transfer heat from refrigerant fluid discharged from the compressor means to the incoming refrigerant flowing into the accumulator, whereby the incoming refrigerant is heated and the discharged refrigerant fluid is substantially condensed, thereby substantially eliminating the need for a dedicated condenser unit typically required in conventional recovery and recycling apparatus.

In accordance with a further unique feature of the invention, the vaporizing means includes a heat exchanger adapted to receive high temperature, high pressure refrigerant fluid discharged in a vapor state from the compressor means, whereby heat is transferred from the discharged refrigerant vapor to the incoming refrigerant fluid. The "unconditioned" vapor refrigerant discharged at high temperature and pressure from the condenser means is "conditioned" by passage through the heat exchanger, such that the incoming refrigerant fluid is heated an the discharged refrigerant vapor is cooled simultaneously.

In accordance with still another unique feature of the invention, the apparatus is usable as a vacuum pump. The apparatus includes pressure sensing means for sensing pressure on the suction side of the compressor means. When the pressure drops below a predetermined minimum limit, the compressor means is disabled from further operation. To operate the apparatus as a vacuum pump, user-operable switch means is provided for bypassing the pressure sensing means, such that the compressor means is operable to draw a vacuum on a unit connected to the inlet means. The compressor means is preferably an external or open drive compressor with its own source of lubricating oil, such that the lubrication of the compressor is not dependent upon the flow of refrigerant therethrough.

In the preferred embodiment, the inlet means includes an inlet port and a suction conduit communicating between the inlet port and the suction side of the compressor means. The outlet means includes an outlet port and a discharge conduit communicating between a discharge side of the compressor means and the outlet port. Located on the suction side of the compressor are filter means for filtering moisture and other contaminants from the incoming refrigerant fluid, an expansion valve for decreasing the pressure of the incoming refrigerant fluid to substantially vaporize the refrigerant fluid, first and second heat exchangers in series for transferring heat to the incoming refrigerant fluid, a combination accumulator/heat exchanger for accumulating liquid refrigerant and for further heating the incoming refrigerant fluid to ensure that the refrigerant fluid reaching the suction side of the compressor has been substantially vaporized. First oil separator means is also located on the suction side of the compressor for separating oil from the incoming refrigerant fluid.

High temperature, high pressure refrigerant vapor discharged by the compressor is conducted to the second heat exchanger for transferring heat to the incoming refrigerant fluid. The discharged refrigerant fluid then passes through two oil separators for further separation of oil from the discharged refrigerant fluid. After passage through the two oil separators, the discharged refrigerant fluid passes through the heat exchanger portion of the accumulator where the discharged refrigerant fluid is substantially condensed. The condensed refrigerant fluid is then conducted to a subcooler for cooling the refrigerant fluid below the corresponding saturated liquid temperature, thereby ensuring that the refrigerant fluid has been substantially completely converted to a liquid state. The subcooled liquid refrigerant passes through the first heat exchanger, where it transfers additional heat to the incoming refrigerant fluid. The subcooled refrigerant fluid passes from the first heat exchanger through the outlet port substantially completely in a liquid state.

The foregoing description of the apparatus pertains to the flow of refrigerant fluid when the apparatus is used for recovery, recycling or replacement of refrigerant fluid. If the apparatus is to be used in a "pump down" mode, the flow of condensed refrigerant fluid bypasses the subcooler and is diverted directly into a discharge line communicating with the outlet port. Furthermore, the refrigerant fluid remaining in the first heat exchanger and subcooler is sucked out of the first heat exchanger and subcooler into a feedback conduit, as previously described, whereby at least some of the refrigerant fluid is returned to the suction side of the compressor. The feedback flow continues until refrigerant fluid has been substantially completely evacuated from the apparatus.

BRIEF DESCRIPTION OF THE DRAWINGS

FIG.'S 1A, 1B and 1C are block diagrams illustrating the refrigerant recovery, recycling and replacement processes, respectively.

DETAILED DESCRIPTION OF THE PREFERRED EMBODIMENT

Figure 1A:
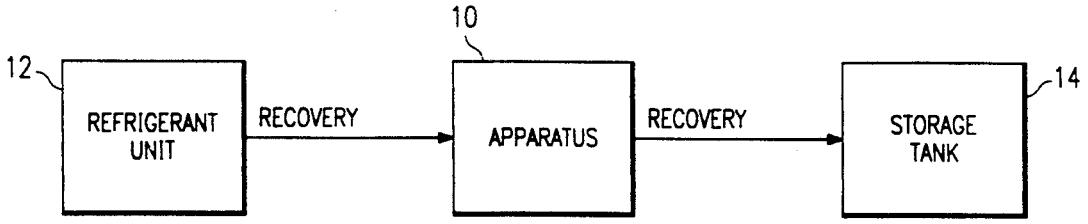

In the description which follows, like parts are marked throughout the specification and drawings with the same respective reference numerals. The drawings are not necessarily to scale and in some instances proportions may have been exaggerated in order to more clearly depict certain features of the invention.

Referring to FIG.'s 1A, 1B and 1C, a refrigerant recovery and recycling apparatus 10 is adapted for refrigerant recovery, recycling and replacement processes. As shown in FIG. 1A, the recovery process involves removing refrigerant from a refrigeration unit 12 (e.g., a refrigerator, air conditioner, heat pump, etc.) and transferring the refrigerant to a temporary storage tank 14. The recovery process further involves filtration of the refrigerant and separation of oil and other contaminants therefrom.

Figure 1B:
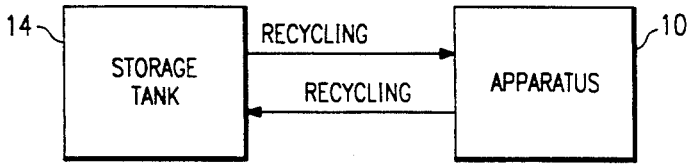

As shown in FIG. 1B, the recycling process involves continuously recirculating the recovered refrigerant between apparatus 10 and storage tank 14. The recycling apparatus involves further filtration of the refrigerant and further separation of oil and other contaminants therefrom.

Figure 1C:
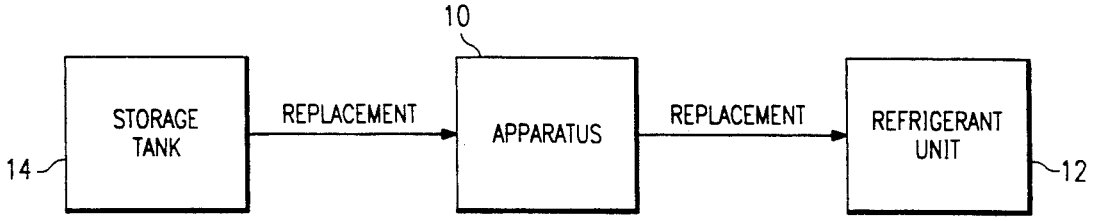

As shown in FIG. 1C, the replacement process involves transferring the refrigerant from storage tank 14 back into refrigeration unit 12 for reuse. Alternatively, if the recovered refrigerant is to be reused in a different refrigeration unit, the refrigerant is typically transported in storage tank 14 to a reclamation center for further purification.

Figure 2:
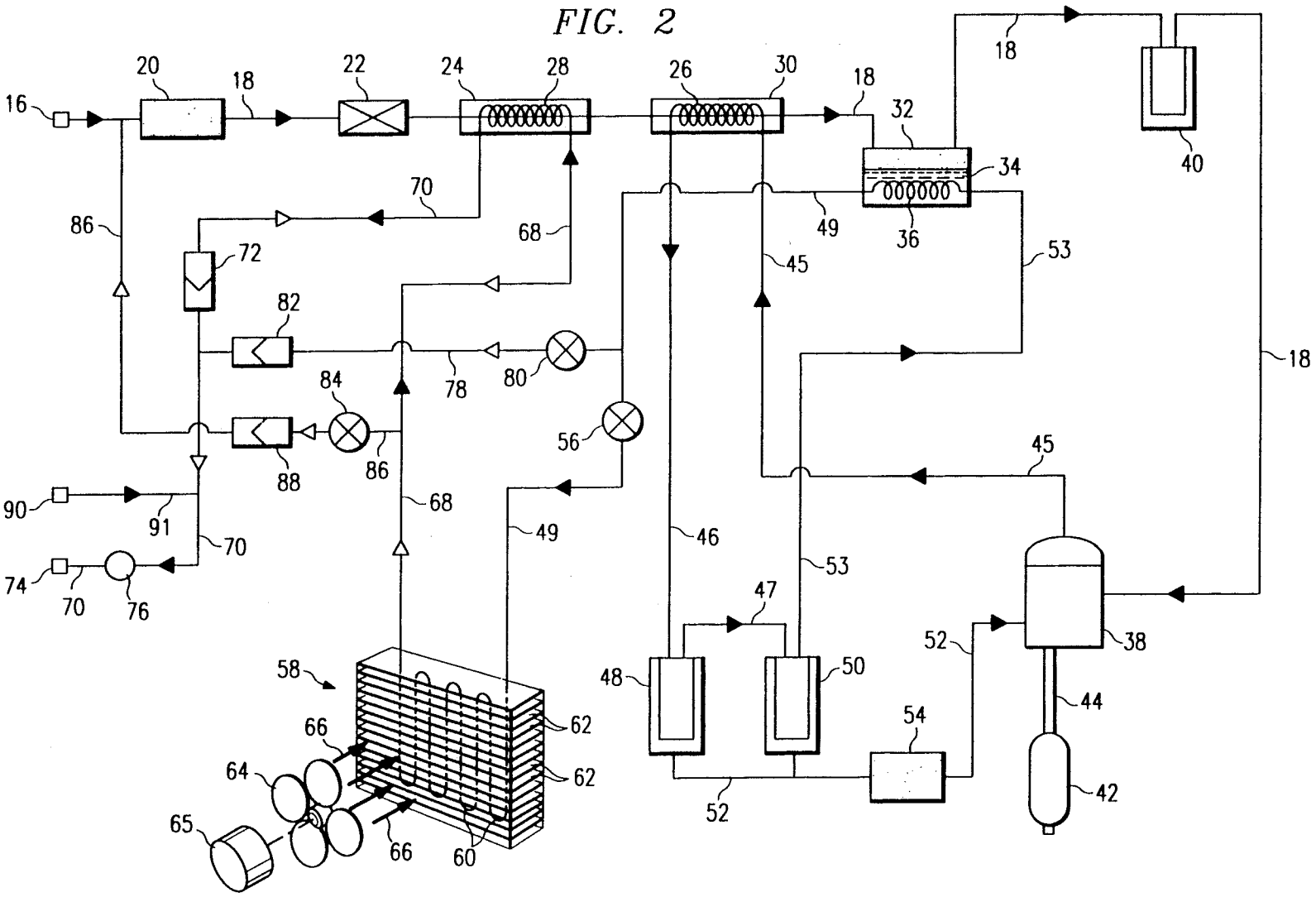
FIG. 2 is a system diagram of the major components of a refrigerant recovery and recycling apparatus, according to the present invention.

Referring now to FIG. 2, refrigerant in either a vapor or a liquid state is removed from a refrigeration unit (not shown), such as a refrigerator, air conditioner or heat pump, by positioning inlet port 16 of apparatus 10 in fluid communication with the refrigeration unit. A conduit, such as a flexible hose (not shown) with appropriate fittings, is used to effect the fluid communication. Refrigerant is introduced into apparatus 10 through suction line 18, which is preferably copper piping having a ⅜ inch diameter. The incoming refrigerant is filtered by an inlet filter 20. Filter 20 is preferably a replaceable core burn-out filter of the PCK-48 type, sold by Parker Hannifin, of Broadview, Ill. Filter 20 includes media for removing moisture, acid, particulate matter and other contaminants.

After filtration, the incoming refrigerant passes through an expansion valve 22, which results in rapid expansion of the refrigerant, whereby the refrigerant is substantially converted to a vapor state. Expansion valve 22 is preferably a constant pressure expansion valve of the XV Model AS or A2 type, sold by Parker Hannifin. Passage through expansion valve 22 not only at least partially vaporizes the refrigerant, but also substantially reduces the pressure thereof due to the rapid expansion. For example, the line pressure of the incoming refrigerant may be on the order of 200 psi. After passage through expansion valve 22, the line pressure of the refrigerant may drop to approximately 35 psi.

The incoming refrigerant then passes through two heat exchangers 24 and 26 in series for further vaporization as a result of heat transfer from discharge refrigerant, as will be described in greater detail hereinafter. Heat exchanger 24 includes a copper helical coil 28 wrapped around suction line 18 in heat exchange relationship therewith. The discharge refrigerant passes through coil 28, such that heat is transferred from the warmer discharge refrigerant to the cooler incoming refrigerant. Similarly, heat exchanger 26 includes a copper helical coil 30 wrapped around suction line 18 in heat exchange relationship therewith. Discharge refrigerant passes through coil 30, such that heat is transferred from the warmer discharge refrigerant to the cooler incoming refrigerant. As a result of the incoming refrigerant being expanded through expansion valve 22 and heated in heat exchangers 24 and 26, the incoming refrigerant reaching accumulator 32 is substantially completely in a vapor state. Any liquid remaining in the refrigerant is collected in the bottom of accumulator 32, as indicated by reference numeral 34. At least partially submerged in the accumulated liquid 34 is a coil 36 having a plurality of turns. Discharge refrigerant passes through coil 36 and transfers heat from the warmer discharge refrigerant to liquid 34, to vaporize at least some of the liquid 34. If accumulator 32 contains no liquid, heat is transferred from coil 36 to the incoming refrigerant to further heat and vaporize the incoming refrigerant. By the time the refrigerant passes through suction line 18 on the discharge side of accumulator 32, refrigerant should be completely vaporized to prevent damage to compressor 38.

Heat exchanger 24 is preferably a heat exchanger of the BH100 type, sold by Refrigeration Research, of Brighton, Mich. Heat exchanger 26 is preferably a heat exchanger of the BH300 type, sold by Refrigeration Research. Accumulator 32 is preferably an accumulator of the HX3702 or HX3703 type, sold by Refrigeration Research.

From accumulator 32, the incoming refrigerant passes through a an oil separator 40 with internal baffling to slow the rate of flow of the incoming refrigerant. When the incoming refrigerant slows down, oil droplets form on the baffles of separator 40, thereby mechanically separating oil from the incoming refrigerant. Oil separator 40 includes a drain port (not shown) for draining collected oil from separator 40 into a recovery vessel (not shown). Oil separator 40 is preferably a canister-type oil separator of the 900.5RR type, sold by Temprite, of West Chicago, Ill.

After oil is separated from the incoming refrigerant, the incoming refrigerant passes into the suction side of compressor 38. Compressor 38 is preferably a reciprocating, twin cylinder, open drive compressor of the 99400-22 type, sold by Blissfield Manufacturing, of Blissfield, Mich. Refrigerant enters the compressor at a pressure of approximately 35 psi. An external drive motor 42 is provided for driving compressor 38. Drive motor 42 is preferably a 1½ horsepower motor of the 606816 type, sold by Emerson Motor Co., of St. Louis, Mo., mechanically coupled to compressor 38 by means of a conventional belt drive mechanism 44. Compressor 38 and motor 42 have their own lubricating oil supply, so that lubrication of compressor 38 and drive motor 42 are not dependent upon the flow of refrigerant through compressor 38.

The temperature and pressure of the refrigerant are increased substantially by compressor 38. For example, the pressure and temperature of the refrigerant on the suction side of compressor 38 may be approximately 35 psi and 55° F., respectively, while the pressure and temperature on the discharge side of compressor 38 may be approximately 165 psi and 135° F., respectively.

The refrigerant is discharged from compressor 38 through a discharge line 45. Discharge line 45 is preferably copper piping having a ½ inch diameter. The "unconditioned" refrigerant (i.e., high pressure, high temperature refrigerant) discharged from compressor 38 is moved through discharge line 45 into coil 30 within heat exchanger 26, where heat is transferred from the unconditioned refrigerant to the incoming refrigerant, as previously described. The unconditioned refrigerant discharged from compressor 38 is in a vapor state. The discharge refrigerant exits heat exchanger 26 as "conditioned" refrigerant through discharge line 46 and is transferred to an oil separator 48. Oil separator 48 is a canister-type separator with internal baffling to slow the rate of refrigerant flow, with resultant forming of oil droplets on the baffles, whereby oil is separated from the conditioned refrigerant. The refrigerant may pick up oil as it passes through compressor 38. Separator 48 is preferably an oil separator of the 901 type, sold by Temprite.

The refrigerant is then transferred via line 47 to another oil separator 50 for further separation of oil from the refrigerant. Separator 50 is also a canister-type oil separator with internal baffling and is preferably a separator of the 901 type, sold by Temprite. The oil collected in separators 48 and 50 is transferred back to the crankcase of compressor 38 via an oil supply line 52. An oil filter 54, which is preferably a filter of the 052 type, sold by Parker Hannifin, is located in oil supply line 52 to filter contaminants from the oil returning to compressor 38. Filter 54 also reduces the pressure of the oil flowing into compressor 38 so that the incoming oil does not create a back pressure on the suction side of compressor 38. As previously mentioned, the conditioned refrigerant entering oil separators 48 and 50 is at a relatively high pressure (e.g., 165 psi). Therefore, the high pressure within oil separators 48 and 50 forces the oil collected therein through oil supply line 52. The pressure is substantially reduced by filter 54 to approximately the suction pressure (e.g., 35 psi). The return of oil to compressor 38 provides a continuous source of lubricating oil for compressor 38, such that compressor 38 is operable even if refrigerant is not flowing through compressor 38.

The conditioned refrigerant is discharged from oil separator 50 through discharge line 53 into coil 36 within accumulator 32. Although the discharge refrigerant loses some of its heat in passing through heat exchanger 26, the conditioned refrigerant is at least partially in a vapor state when it enters accumulator 32. Coil 36 is in heat exchange relationship with liquid refrigerant 34 in accumulator 32 and with the incoming refrigerant vapor above liquid 34. Experimental tests have shown that the conditioned refrigerant is substantially condensed as it passes through coil 36, such that the conditioned refrigerant discharged from coil 36 through discharge line 49 is substantially in a liquid state. The liquid refrigerant is moved through discharge line 49, through a solenoid-operated valve 56 into another heat exchanger 58. Solenoid-operated valve 56 is preferably a solenoid valve of the RB6E4 type, sold by Parker Hannifin. Solenoid-operated valve 56 is normally in an open position for allowing liquid refrigerant to flow into heat exchanger 58. Heat exchanger 58 is preferably a heat exchanger of the Model 3CZ1203C type, sold by Heatcraft, Inc., of Granada, Miss.

Heat exchanger 58 has an internal copper tube 60 with a plurality of U-shaped turns and a plurality of fins 62 for directing the flow of cooling air across tube 60. A cooling fan 64 is provided for blowing air through heat exchanger 58 in the direction of arrows 66. Fan 64 is driven by a motor 65, which is preferably a motor of the G.E. 5311 type, sold by G.E. Supply, of Dallas, Tex. Heat exchanger 58 functions in much the same manner as an automobile radiator by air-cooling the liquid refrigerant flowing through tube 60. Because the discharge refrigerant has been substantially liquified before reaching heat exchanger 58, heat exchanger 58 functions as a subcooler to further cool the discharge refrigerant. Any vapor remaining in the discharge refrigerant is condensed within heat exchanger 58, so that the output of heat exchanger 58 is refrigerant in a substantially liquid state.

Liquid refrigerant is discharged from heat exchanger 58 through discharge line 68 into tube 28 within heat exchanger 24. The liquid refrigerant is further cooled by the transfer of heat from the liquid refrigerant to the incoming refrigerant flowing through suction line 18, as previously described. The liquid refrigerant exits heat exchanger 24 through discharge line 70. The refrigerant flowing through discharge line 70 passes through a check valve 72, which allows one-way flow of fluid through discharge line 70, as indicated by the appropriate arrow and out of apparatus 10 through an outlet port 74. A sight glass 76 is located slightly upstream of outlet port 74 to allow visual detection of any moisture contained in the outgoing refrigerant. Sight glass 76 is preferably a sight glass of the PSG-35 type, sold by Parker Hannifin. The outgoing refrigerant is preferably transferred to a temporary storage tank (not shown).

The flow of refrigerant into and out of apparatus 10, described above with reference to FIG. 2, constitutes the refrigerant recovery process depicted in FIG. 1A, whereby refrigerant is removed from a refrigeration unit 12 and transferred to a temporary storage tank 14. Storage tank 14 preferably includes a vapor port (not shown) and a liquid port (not shown). In the refrigerant recovery mode of operation, outlet port 74 is coupled by a conduit, such as flexible hose or the like (not shown), to the vapor port of storage tank 14. Inlet port 16 is of course coupled to refrigeration unit 12 for removing refrigerant therefrom.

In the recycling mode of operation, as depicted in FIG. 1B, inlet port 16 is coupled to the liquid port of storage tank 14 by means of a conduit, such as a flexible hose or the like (not shown). Outlet port 74 remains in fluid communication with the vapor port of storage tank 14. Otherwise, the recycling mode of operation is substantially the same as the recovery mode of operation, described above with reference to FIG. 2. The refrigerant is recycled between storage tank 14 and apparatus 10 in a continuous recirculating loop. The recycling mode of operation involves continuous filtration of the refrigerant to remove moisture and other contaminants therefrom and continuous separation of oil from the refrigerant as the refrigerant is continually recirculated through apparatus 10. In the replacement mode of operation, as shown in FIG. 1C, inlet port 16 is in fluid communication with the liquid port of storage tank 14 and outlet port 74 is in fluid communication by means of a conduit, such as flexible hose or the like (not shown), with refrigeration unit 12 to restore the refrigerant previously removed from refrigeration unit 12. The flow of refrigerant in the recovery, recycling and replacement modes is indicated by the black arrows in FIG. 2.

In addition to the recovery, recycling and replacement processes described above, apparatus 10 includes a "pump down" mode of operation, which involves removing substantially all of the refrigerant from apparatus 10. "Pump down" is accomplished by providing a bypass line 78 for bypassing heat exchanger 58. A solenoid-operated valve 80 is located in bypass line 78. Solenoid-operated valve 80 is preferably a solenoid-operated valve of the RB3ES type, sold by Parker Hannifin. During the recovery, recycling and replacement modes of operation, solenoid-operated valve 56 is in an open position for admitting liquid refrigerant into heat exchanger 58, while solenoid-operated valve 80 is in a closed position to prevent liquid refrigerant from flowing into bypass line 78. In the "pump down" mode of operation, solenoid-operated valve 56 is closed to prevent the flow of refrigerant into heat exchanger 58, while solenoid-operated valve 80 is opened to shunt refrigerant from discharge line 49 into bypass line 78. A check valve 82 is located in bypass line 78 to allow one-way flow of fluid through bypass line 78 in the direction indicated by the appropriate arrow.

A third solenoid-operated valve 84, which is also preferably a solenoid-operated valve of the RB3ES type, sold by Parker Hannifin, is located in a feedback line 86. Feedback line 86 is in fluid communication with discharge line 68. Solenoid-operated valve 84 is in a closed position during the recovery, recycling and replacement modes and is in an open position during the "pump down" mode. A check valve 88 is located downstream of solenoid-operated valve 84 to allow only one-way flow of fluid through feedback line 86.

In the "pump down" mode of operation, the flow of refrigerant in lines 68, 70, 78 and 86 is indicated by the white arrows. Outlet port 74 is decoupled from storage tank 14 into which the refrigerant has been transferred during the recovery mode and is coupled instead to an empty storage tank (not shown). Furthermore, in the "pump down" mode, valve 56 is closed and valves 80 and 84 are opened, such that liquid refrigerant flowing through discharge line 49 is shunted through bypass line 78 into discharge line 70 and out of apparatus 10 throughout outlet port 74. Furthermore, in the "pump down" mode the refrigerant remaining in heat exchanger 58 is evacuated therefrom through discharge line 68 into feedback line 86. Feedback line 86 transfers refrigerant back to suction line 18 to continuously feed suction line 18. A continuous feedback of refrigerant into suction line 18 is required to prevent apparatus 10 from being disabled by a low pressure switch cutout (not shown) when the suction pressure drops below a predetermined minimum limit. Feedback line 86 taps into suction line 18 between inlet port 16 and filter 20.

In the "pump down" mode compressor 38 sucks the refrigerant in discharge line 70 between check valve 72 and heat exchanger 24 back through heat exchanger 24 and into feedback line 86. Therefore, in the "pump down" mode, refrigerant is moved in both directions in discharge line 68 into feedback line 86 to provide a continuous fluid feedback into suction line 18. Solenoid-operated valve 84, check valve 88 and feedback line 86 provide a "seep circuit" to continuously feed suction line 18, so that refrigerant can be completely evacuated from apparatus 10 without activating the low pressure switch cutout.

Check valve 72 prevents the backflow of refrigerant in discharge line 70 between check valve 72 and outlet port 74 during the "pump down" and "quick liquid recovery" modes. Check valve 82 prevents the backflow of refrigerant through bypass line 78 during the recovery, recycling, replacement and "quick liquid recovery" modes. Check valve 88 prevents the back flow of refrigerant into feedback line 86 during the recovery, recycling and replacement modes. Valves 80 and 84 effectively prevent flow through lines 78 and 86, respectively, in the direction of the white arrows when valves 80 and 84 are closed (i.e., in the recovery, recycling and replacement modes). Solenoids 80 and 84 are prone to leakage in the reverse direction. Hence, check valves 82 and 88 are provided to enhance the integrity of the apparatus.

In accordance with another aspect of the invention, apparatus 10 is usable as a vacuum pump. In the "vacuum pump" mode of operation, inlet port 16 is coupled by a conduit, such as a flexible hose or the like (not shown), to a unit (not shown) in which a vacuum is to be created. A discharge hose (not shown) is connected to outlet port 74. A vacuum pump switch is provided for bypassing the low pressure switch. When the low pressure switch is bypassed, compressor 38 is operable to draw a vacuum on the unit coupled to inlet port 16. Apparatus 10 is operable in the "vacuum pump" mode to pull a vacuum down to approximately 4000 microns. To reuse apparatus 10 in the recovery mode, another vacuum pump (not shown) is coupled to outlet port 74 to pull a vacuum on the discharge side of compressor 38.

In accordance with another feature of the invention, a "quick liquid recovery" capability is provided. A "quick liquid recovery" port 90 is in fluid communication via line 91 with discharge line 70 between check valve 72 and outlet port 74. In circumstances where it is desired to rapidly recover refrigerant from a unit without having to pass the refrigerant through entire apparatus 10, the "quick liquid recovery" port 90 is coupled to the refrigeration unit (not shown) from the which the refrigerant is to be recovered. The refrigerant pressure within the unit is typically sufficient to force the refrigerant from the unit into line 90 and through discharge line 70 and outlet port 74 into a storage tank (not shown). The "quick liquid recovery" mode is particularly well-suited when incoming refrigerant is substantially in a liquid state, so that the refrigerant can be transferred directly to a storage tank in the liquid state. Sight glass 76 is located in discharge line 70 for detecting the presence of moisture and other contaminants in the outgoing refrigerant. If moisture or other contaminants are detected, it is preferable to use the recovery mode instead of the "quick liquid recovery" mode to filter out moisture and other contaminants. Check valves 72 and 82 prevent the backflow of refrigerant into discharge lines 70 and 78 during the "quick liquid recovery" mode.

Figure 3:
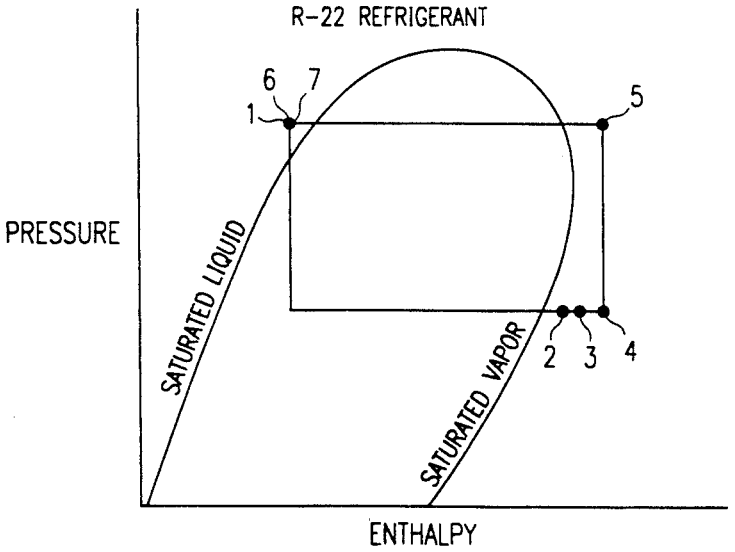
FIG. 3 is a Pressure-Enthalpy diagram, illustrating the thermodynamics of the refrigerant recovery process.

Referring now to FIG. 3, the thermodynamic cycle of the refrigerant in the recovery mode is depicted. Point 1 represents liquid refrigerant entering apparatus 10 through filter 20. Point 1 is to the left of the saturated liquid line, which indicates that the incoming refrigerant is in a liquid state. Expansion valve 22 and heat exchangers 24 and 26 are effective to transform the liquid to a vapor state, as indicated by point 2, which is slightly to the right of the saturated vapor line. The vaporized refrigerant is superheated in accumulator 32, oil separator 40 and in the suction piping 18 between accumulator 32 and oil separator 40, as indicated by points 3 and 4 further to the right of the saturated vapor line.

Point 5 represents the refrigerant in a vapor state on the discharge side of compressor 38, as indicated by the increased pressure of the refrigerant between points 4 and 5. Points 6 and 7 correspond with point 1 and represent the refrigerant in discharge line 49 between accumulator 32 and heat exchanger 58. The fact that points 6 and 7 are to the left of the saturated liquid line indicates that the refrigerant has been substantially condensed before entering heat exchanger 58. In essence, heat exchanger 58, instead of serving as a condenser, functions as a subcooler to further cool the condensed refrigerant.

Figure 4:
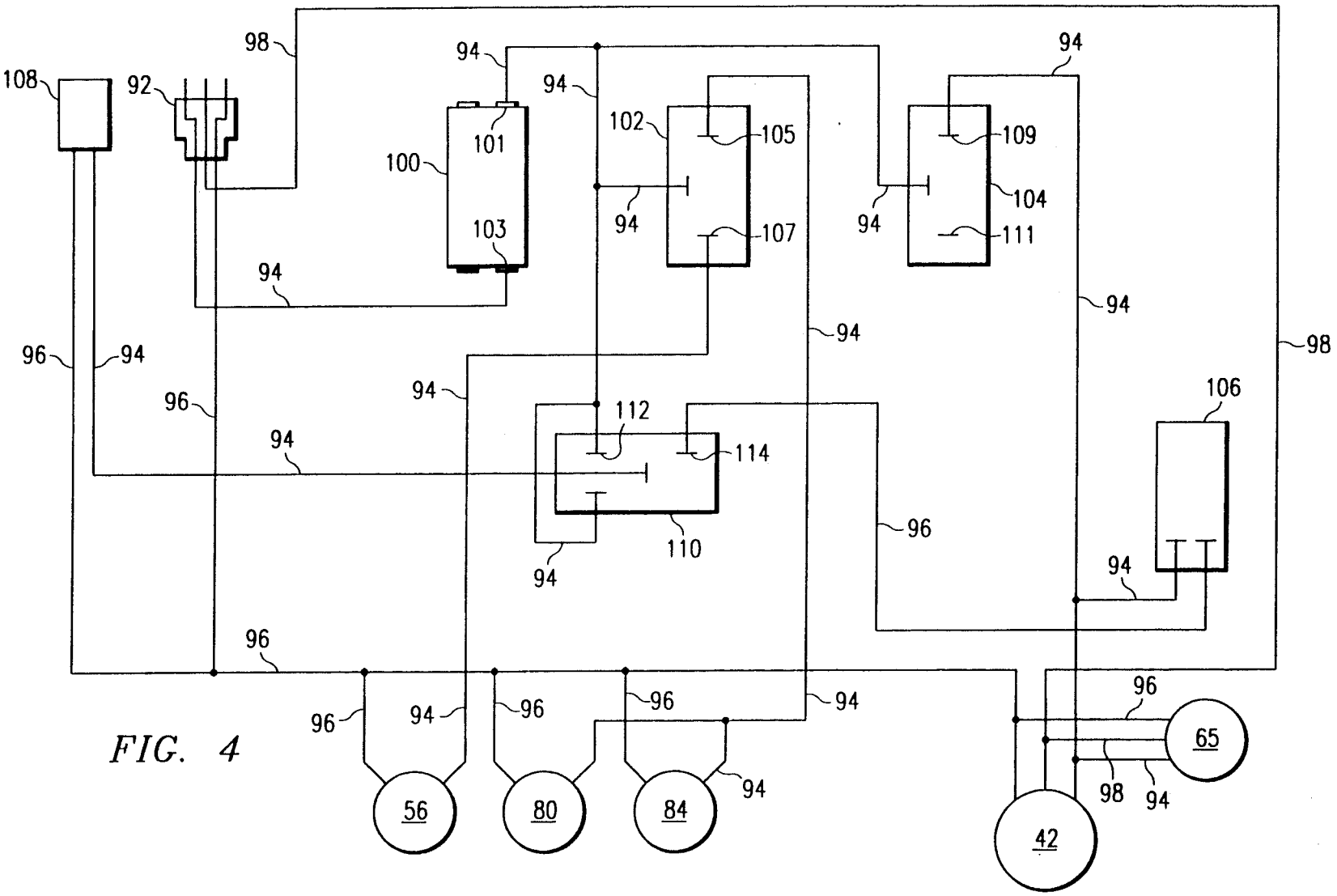
FIG. 4 is an electrical circuit diagram of the apparatus of FIG. 2.

Referring now to FIG. 4, the electrical circuitry of apparatus 10 includes a three-pronged plug 92, which is connectable to a source of AC electrical power (not shown). Electrical conductors 94, 96 and 98 emanating from plug 92 correspond to the "hot", common and ground conductors, respectively. A power switch 100 has "on" and "off" positions 101 and 103, respectively, for selectively connecting and disconnecting the external power supply to apparatus 10. Power switch 100 is preferably a single pole, double throw switch of the 2X633 type, manufactured and sold by Grainger, of Fort Worth, Tex.

A solenoid control switch 102 is provided for controlling the operation of solenoid-operated valves 56, 80 and 84. Switch 102 is preferably a single pole, double throw switch of the 2X465 type, manufactured and sold by Grainger. Switch 102 has "RUN" and "PUMP DOWN" switch positions 105 and 107, respectively. The normal operating position of switch 102 (i.e., in the recovery, recycling and replacement modes) is in "RUN" position 105. In "RUN" switch position 105, valve 56 is in the open position and valves 80 and 84 are in the closed positions. In "PUMP DOWN" switch position 107, valve 56 is closed and valves 80 and 84 are opened. "PUMP DOWN" switch position 107 corresponds to the "pump down" mode previously described.

A vacuum pump switch 104 is provided for bypassing the low pressure switch cutout of apparatus 10, as previously described. Vacuum pump switch 104 is preferably a single pole, double throw switch of the 2X465 type, manufactured and sold by Grainger. Switch 104 has "RUN" and "VACUUM PUMP" switch positions 109 and 111, respectively. Switch 104 is normally in "RUN" position 109 (i.e., in the recovery, recycling and replacement modes). In "RUN" position 109, electrical power is transmitted to compressor motor 42 through a dual pressure switch 106. Dual pressure switch 106 includes both a high pressure switch cutout and the low pressure switch cutout previously described. The high pressure switch cutout operates to disable compressor motor 42 when the discharge pressure exceeds a predetermined maximum pressure (e.g., 325 psi). The low pressure switch cutout operates to disable compressor motor 42 when the suction pressure drops below a predetermined minimum limit (e.g., below 10 inches of mercury). When switch 104 is switched to "VACUUM PUMP" position 111, dual pressure switch 106 is bypassed so that electrical power is supplied directly to compressor motor 42 on "hot" conductor 94 through switch 104. Dual pressure switch 106 is preferably a pressure switch of the 012-1502-00 type, sold by Ranco, of Plain City, Ohio.

Some refrigerant storage tanks include a float sensor 108 for detecting the level of refrigerant within the corresponding tank. When the refrigerant reaches a predetermined level, an electromagnetic relay 110 is activated, which breaks the electrical circuit connection between terminals 112 and 114 of relay 110. Relay 110 is preferably a relay of the Steveco 90-294 type, sold by Johnstone Supply, of Fort Worth, Tex. When the electrical connection between terminals 112 and 114 is broken, electrical power is disconnected from both compressor motor 42 and fan motor 65. If the refrigerant pressure within the storage tank becomes too great, the excessive pressure may cause the storage tank to vent refrigerant or to explode if the excessive refrigerant is not vented. It is therefore important to interrupt the operation of compressor 38 if the refrigerant pressure becomes too high in the refrigerant storage tank.

The recovery and recycling apparatus according to the present invention provides numerous advantages over refrigerant recovery and recycling apparatus heretofore known in the art. Among the unique features of the apparatus according to the present invention are the use of an accumulator as a heat exchanger, which facilitates the conversion of the discharge refrigerant to a liquid, and the "seep circuit" which provides a feedback flow of refrigerant to the suction line, such that the apparatus can be "pumped down" to remove substantially all of the refrigerant therefrom. Other unique features of the apparatus include the use of "unconditioned" vapor discharged at a high temperature and pressure from the compressor to transfer heat to the incoming refrigerant, such that the conditioning process begins very early in the discharge cycle. This feature not only facilitates heating of the incoming refrigerant, but also facilitates the process of condensing the discharge refrigerant so that a heat exchanger normally used as a condenser is used as a subcooler to ensure that substantially all vestiges of vapor are removed from the discharged refrigerant. The "quick liquid recovery" capability of the apparatus and the ability to use the apparatus as a vacuum pump by bypassing the low pressure limit switch are also among the unique features of the apparatus. The open drive compressor allows the apparatus to be used in a "pump down" mode and as a vacuum pump because lubrication of the compressor and compressor drive motor are not dependent on the flow of refrigerant through the compressor.

The preferred embodiment of the invention has now been described in detail. Since it is obvious that many changes in and additions to the above-described preferred embodiment may be made without departing from the nature, spirit and scope of the invention, the invention is not to be limited to the disclosed details, except as set forth in the appended claims.

What is claimed is:

1. Apparatus for recovering and recycling refrigerant fluid, comprising:

inlet means positionable in fluid communication with a source of refrigerant fluid for introducing refrigerant fluid into said apparatus;

vaporizing means for substantially completely vaporizing incoming refrigerant fluid;

compressor means for compressing vaporized refrigerant fluid to increase the temperature and pressure thereof;

condensing means for substantially completely condensing compressed refrigerant fluid;

outlet means for expelling condensed refrigerant fluid from said apparatus;

the apparatus having selectable "recovery" and "pump down" modes of operation; and feedback means selectively operable in the "pump down" mode of operation for returning a portion of the refrigerant fluid from said outlet means to said inlet means to provide a flow of refrigerant fluid through said inlet means.

2. Apparatus of claim 1 wherein said inlet means includes an inlet port and an inlet conduit for conducting refrigerant fluid introduced into said apparatus through said inlet port, said outlet means including an outlet port and an outlet conduit for conducting refrigerant fluid discharged from said compressor means to said outlet port, said feedback means including a feedback conduit coupled between said inlet and outlet conduits, said feedback means further including valve means for inhibiting the flow of refrigerant fluid through said feedback conduit when said valve means is in a "recovery" mode position and for allowing the flow of refrigerant fluid through said feedback conduit from said outlet conduit to said inlet conduit when said valve means is in a "pump down" mode position, to provide said flow of refrigerant fluid, whereby the refrigerant fluid is substantially completely removable from said apparatus in said "pump down" mode.

3. Apparatus of claim 2 wherein said valve means includes a solenoid-operated valve, selectively operable in said "recovery" mode and "pump down" mode positions and a check valve located between said solenoid-operated valve and said inlet conduit for allowing one way flow of refrigerant fluid through said feedback conduit from said outlet conduit to said inlet conduit when said solenoid-operated valve is in said "pump down" mode position.

4. Apparatus of claim 1 wherein said inlet means includes a first inlet port and a first inlet conduit for conducting refrigerant fluid introduced into said apparatus through said first inlet port, said inlet means further including a second inlet port and a second inlet conduit in direct fluid communication with said outlet means, said second inlet port being positionable in fluid communication with a refrigeration unit for receiving refrigerant fluid therefrom, whereby refrigerant fluid is conducted through said second inlet conduit directly to said outlet means for rapid expulsion from said apparatus without being vaporized by said vaporization means, compressed by said compressor means and condensed by said condensing means.

5. Apparatus of claim 4 wherein said outlet means includes an outlet port and an outlet conduit, said outlet conduit being in fluid communication with said second inlet conduit, said compressor means being intermediate said first inlet conduit and said outlet conduit, said apparatus further including visual inspection means located in said outlet conduit for allowing visual inspection of refrigerant fluid expelled through said outlet port.

6. Apparatus of claim 1 wherein said vaporizing means includes accumulator means located between said inlet means and said compressor means for accumulating liquid refrigerant fluid, said accumulator means further including a heat exchanger for transferring heat from the compressed refrigerant fluid to the incoming refrigerant fluid.

7. Apparatus of claim 6 wherein the compressed refrigerant fluid is substantially completely condensed as a result of the transfer of heat from the compressed refrigerant fluid to the incoming refrigerant fluid.

8. Apparatus of claim 6 wherein said accumulator means includes a container having an inlet opening for receiving the incoming refrigerant fluid and an outlet opening for allowing the incoming refrigerant fluid to escape from said container, said accumulator means further including a heating conduit in heat exchange relationship with the incoming refrigerant fluid, the compressed refrigerant fluid being movable through said heating conduit by said compressor means, whereby heat from the compressed refrigerant fluid is transferred to the incoming refrigerant fluid.

9. Apparatus of claim 1 wherein said vaporizing means includes heat exchanger means for transferring heat from the compressed refrigerant fluid to the incoming refrigerant fluid, said heat exchanger means including means for transferring heat from the compressed refrigerant fluid discharged from said compressor means in a vapor state to the incoming refrigerant fluid.

10. Apparatus of claim 9 wherein said heat exchanger means includes first and second heat exchangers in series between said inlet means and said compressor means, said first heat exchanger including means for transferring heat from the condensed refrigerant fluid to the incoming refrigerant fluid, said second heat exchanger including means for transferring heat from the compressed refrigerant fluid discharged from the compressor means in a vapor state to said incoming refrigerant fluid.

11. Apparatus of claim 1 further including superheating means for heating the incoming refrigerant fluid to a temperature greater than the corresponding saturated vapor temperature.

12. Apparatus of claim 1 further including subcooler means for cooling the condensed refrigerant fluid to a temperature less than the corresponding saturated liquid temperature.

13. Apparatus of claim 1 further including filter means for filtering the incoming refrigerant fluid.

14. Apparatus of claim 1 further including oil separator means for separating oil from the refrigerant fluid.

15. Apparatus for recovering and recycling refrigerant fluid, comprising:

inlet means positionable in fluid communication with a source of refrigerant fluid for introducing refrigerant fluid into said apparatus;

vaporizing means for substantially completely vaporizing incoming refrigerant fluid;

compressor means for compressing vaporized refrigerant fluid to increase the temperature and pressure thereof;

condensing means for substantially completely condensing compressed refrigerant fluid;

outlet means for expelling condensed refrigerant fluid from said apparatus;

feedback means selectively operable for returning at least a portion of the refrigerant fluid form said outlet means to said inlet means to provide a flow of refrigerant fluid through said inlet means; and wherein said inlet means includes an inlet port and a suction conduit communicating between said inlet port and said compressor means, said apparatus further including pressure sensing means for sensing pressure in said suction conduit, said pressure sensing means being operable to disable said compressor means in response to the pressure in said suction conduit falling below a predetermined minimum limit, said apparatus further including user-operable switch means for disabling said pressure sensing means, whereby said apparatus is usable as a vacuum pump to draw vacuum in a unit which is in fluid communication with said inlet port.

16. Apparatus for recovering and recycling refrigerant fluid, comprising:

inlet means positionable in fluid communication with a source of refrigerant fluid for introducing refrigerant fluid into said apparatus;

vaporizing means for substantially completely vaporizing incoming refrigerant fluid, said vaporizing means including an accumulator for receiving the incoming refrigerant fluid and for accumulating unvaporized liquid refrigerant, said accumulator including a heat exchanger for transferring heat to the incoming refrigerant fluid in said accumulator;

compressor means for compressing vaporized refrigerant fluid to increase the temperature and pressure thereof;

condensing means for substantially completely condensing compressed refrigerant fluid, said heat exchanger including means for transferring heat from the compressed refrigerant fluid to the incoming refrigerant fluid in said accumulator, whereby the compressed refrigerant fluid is substantially completely condensed in said accumulator;

outlet means for expelling condensed refrigerant fluid from said apparatus;

feedback means selectively operable for returning at least a portion of the refrigerant fluid from said outlet means to said inlet means to provide a flow of refrigerant fluid through said inlet means;

wherein said inlet means includes an inlet port and a suction conduit communicating between said inlet port and said compressor means for conducting the incoming refrigerant fluid to said compressor means, said outlet means including an outlet port and a discharge conduit communicating between said compressor means and said outlet port for conducting refrigerant fluid discharged from said compressor means to said outlet port, said apparatus further including means for substantially evacuating refrigerant fluid from said apparatus, said evacuation means including;

bypass means for diverting the flow of condensed refrigerant fluid from said accumulator to said outlet port, whereby said subcooler means is bypassed; and feedback means coupled between said suction conduit and said discharge conduit for providing a flow of refrigerant fluid from said discharge conduit to said suction conduit; and wherein said bypass means includes a bypass conduit communicating between a portion of said discharge conduit between said accumulator and said subcooler means and a portion of said discharge conduit between said first heat exchanger and said outlet port, said bypass means further including bypass valve means operable in a first position for inhibiting the flow of refrigerant fluid in said bypass conduit and in a second position for allowing the flow of refrigerant fluid in said bypass conduit, to divert the flow of refrigerant fluid away from said subcooler means.

17. Apparatus of claim 16 wherein said feedback means includes a feedback conduit communicating between a portion of said discharge conduit between said subcooler means and said first heat exchanger and a portion of said suction conduit between said inlet port and said filter means, said feedback means further including feedback valve means operable in a first position for inhibiting the flow of refrigerant fluid through said feedback conduit and in a second position for allowing refrigerant fluid to flow through said feedback conduit from said portion of said discharge conduit between said subcooler means and said first heat exchanger to said portion of said suction conduit between said inlet port and said filter means.

* * * * *